US006042423A

United States Patent [19]

Murr et al.

[11] Patent Number: 6,042,423

[45] Date of Patent: Mar. 28, 2000

[54] ALIGNMENT ADAPTERS FOR POST HEADER

[75] Inventors: Keith McQuilkin Murr, York; John Thomas Larkin, Jr., New Cumberland, both of Pa.

[73] Assignee: The Whitaker Corporation, Wilmington, Del.

[21] Appl. No.: 09/010,465

[22] Filed: Jan. 21, 1998

Related U.S. Application Data

[60] Provisional application No. 60/038,530, Feb. 27, 1997.

[51] Int. Cl.[7] ..... H01R 13/40

[52] U.S. Cl. ..... 439/590; 439/78

[58] Field of Search ..... 439/78, 74, 590

[56] References Cited

U.S. PATENT DOCUMENTS

| | | | |
|---|---|---|---|
| 3,184,705 | 5/1965 | Obert et al. | 439/680 |
| 3,325,771 | 6/1967 | Ruehlemann et al. | 439/681 |
| 3,601,770 | 8/1971 | Bowley | 439/563 |
| 5,173,063 | 12/1992 | Barkus et al. | 439/681 |
| 5,507,653 | 4/1996 | Stoner | 439/74 |
| 5,785,536 | 7/1998 | McCartin et al. | 439/78 |

OTHER PUBLICATIONS

*AMP Data Sheet 82–663*, "AMPMODU Breakaway Headers (Unshrouded)", Revised Oct. 1984; pp. 1, 2; AMP Incorporated, Harrisburg, PA.

*AMP Drawing No. C–146508*, "Header Assembly, MOD II, Stacking, Double Row, .025 sq. Post, Unshrouded", two pages, (Nov. 1996); AMP Incorporated, Harrisburg, PA.

International Search Report in corresponding PCT/US98/03599 mailed May 27, 1998; two pages.

*Primary Examiner*—Neil Abrams
*Assistant Examiner*—T C Patel

[57] ABSTRACT

A header assembly (10) having an array of posts (12,14) extending through plastic bodies (16,18) with end portions extending beyond opposed header faces for connection with circuits of a pair of parallel, spaced circuit boards. Adapters (40) are securable at ends (32,34) of the assembly that self-secure to end posts (12) and include alignment posts (50) along one face (26), such that after the header assembly has been mounted onto a first circuit board, the alignment posts provide for blindmate alignment with a connector of the second circuit board (or directly with the second circuit board) for board-to-board interconnection.

9 Claims, 2 Drawing Sheets

ALIGNMENT ADAPTERS FOR POST HEADER

This application claims the benefit of U.S. Provisional Application No. 60/038,530, filed Feb. 27, 1997.

FIELD OF THE INVENTION

This relates to the field of electrical connectors and more particularly to circuit board mounted headers.

BACKGROUND OF THE INVENTION

Header connectors are known in which an array of posts are held in a plastic housing in a manner that allows first ends of the posts to extend from the housing for insertion into corresponding through-holes of a circuit board, and second ends of the posts to extend from the housing for establishing electrical connections with complementary contacts of a mating connector. One such header sold by AMP Incorporated, Harrisburg, Pa. is the AMPMODU MOD II header having Part No. 2-146508-5, is an unshrouded header in which an array of fifty elongate posts extend in two rows through spaced-apart plastic bodies molded therearound to be positioned proximate the first and second ends of the posts, with post end portions extending beyond opposed mating faces thereof for mating with contacts of complementary board-mounted receptacle connectors for interconnection of parallel spaced circuit boards.

It is desired to provide a header with means for aligning with a mating connector.

SUMMARY OF THE INVENTION

The present invention is an adapter that is easily assembled to an unshrouded header by snapping onto the posts at each end of the header. Each adapter includes a body section extending alongside the end posts and ends of the respective plastic bodies, with an alignment post extending from one end of the body section along the mating face of the header. Fastening sections extend from the body section adjacent each plastic body toward the posts, and post-receiving grooves extend toward the body section from post-receiving entrances such that the end posts are urged into respective grooves until fully seated. The adapter establishes a force-fit with the posts and preferably retention embossments are defined along inner walls of the grooves adjacent the inner groove ends, that snap around the posts upon full insertion thereof into the grooves.

The adapter of the present invention provides alignment along the header's mating face while requiring no modification of the existing unshrouded header, all thus being highly economical.

An embodiment of the adapter will now be described by way of example with reference to the accompanying drawings.

DETAILED DESCRIPTION

Figure 1:
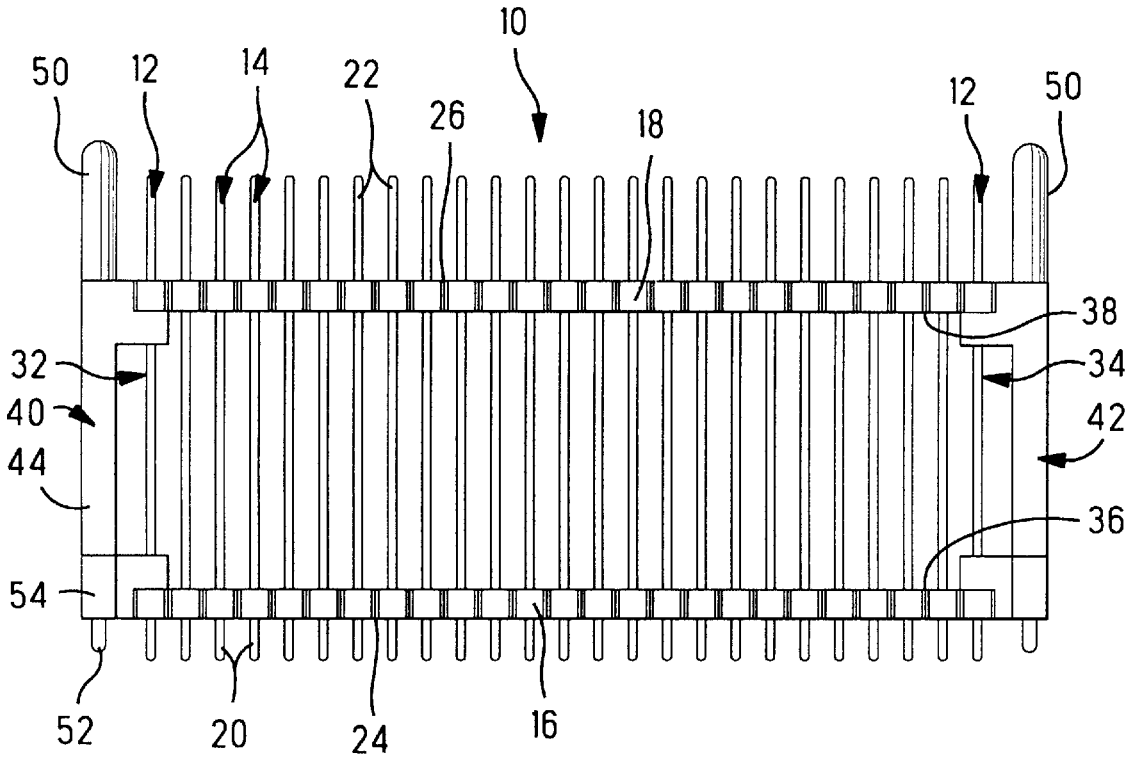
FIG. 1 is an elevation view of a header connector fully assembled with a pair of adapters.

Header 10 includes an array of elongated posts 12,14 extending through plastic bodies 16,18 proximate first and second end portions 20,22 of the post array, such that post end portions extend beyond the two plastic bodies 16,18, with first end portions 20 at first connection or mounting face 24 and second end portions 22 at second connection or mating face 26 of the header. The posts and plastic bodies define a header subassembly 28 that is conventionally fabricated by force fitting the posts into and through openings of the two plastic bodies, for connection between opposed parallel circuit boards. (Optionally the header could be made in an insert molding process in which plastic bodies 16,18 would be molded around the posts to form a continuous strip.) Frangible sections 30 are defined between all adjacent ones of the posts along the two rows by opposed notches and necked-down joints, permitting easy and accurate severing at any location to create header lengths as desired. Adapters 40,42 are preferably identical to each other and are affixed at each end 32,34 of the header subassembly adjacent end posts 12.

Each adapter 40,42 is shown to have a body section 44 extending between first and second ends 46,48 alongside end posts 12 between plastic bodies 16,18. An alignment post 50 extends from second end 48 of the body section at mating face 26 to cooperate with complementary alignment openings of a receptacle connector mounted on a second circuit board (not shown) for alignment of the header and the receptacle connector in a conventional blindmate manner. Optionally, the alignment posts could be received into alignment openings of the second circuit board directly where a receptacle connector is not desired. Each adapter 40,42 is also shown to have a locating post 52 extending from first end 46 of body section 44 at first face 24 to be received in a locating hole of a first circuit board (not shown) to which the header is first mounted, having circuits to which posts 12,14 are electrically connected. Buttresses 54 are also provided at first end 46 of the adapters that serve to stabilize header 10 on the first circuit board upon mounting. Optionally, header 10 may be mated to a complementary receptacle connector mounted on the first circuit board, if desired.

Each adapter 40,42 is shown to include fastening projections 56,58 proximate first and second ends 46,48 to extend inwardly along inner surfaces 36,38 of plastic bodies 16,18 to a post-proximate or inner end 60. Post-receiving grooves 62 are defined in fastening projections 56,58 to extend toward body section 44 from entrances 64 at post-proximate end 60. Preferably entrances 64 include lead-ins formed by chamfered surfaces 66 facilitating receipt of posts 12 thereinto during assembly.

Figure 4:
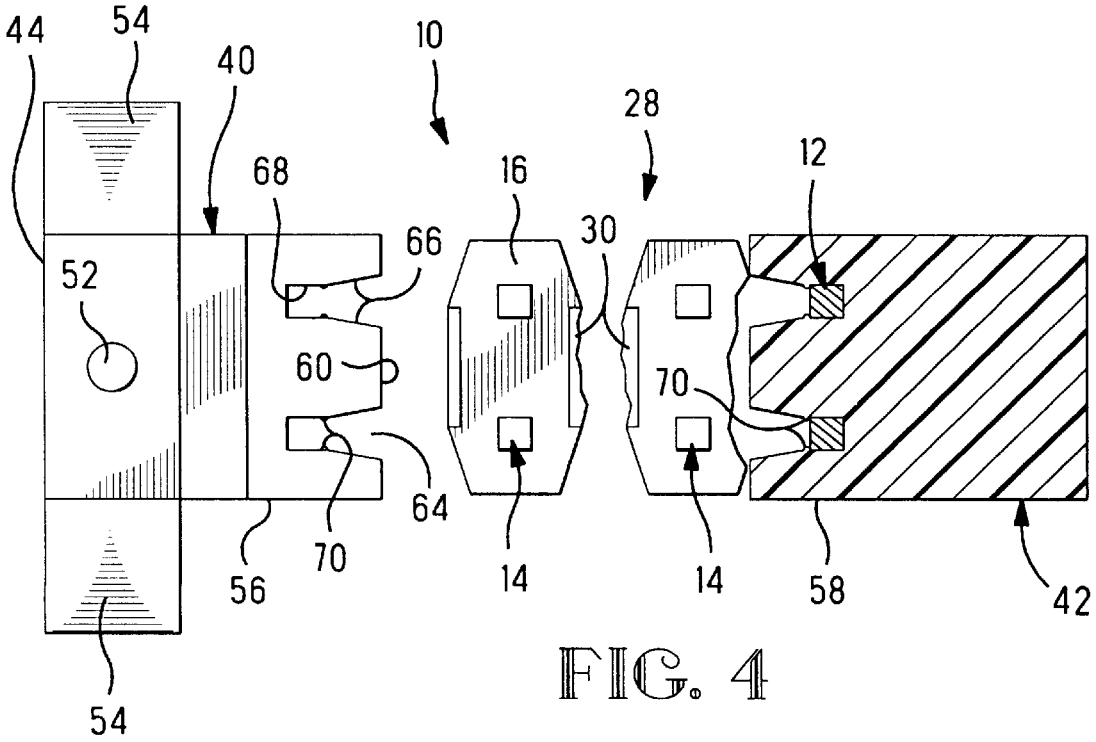
FIG. 4 is a bottom plan view of the header of FIG. 2 cross-sectioned at one end taken along lines 4—4 thereof, illustrating retention to the header posts.
Figure 2:
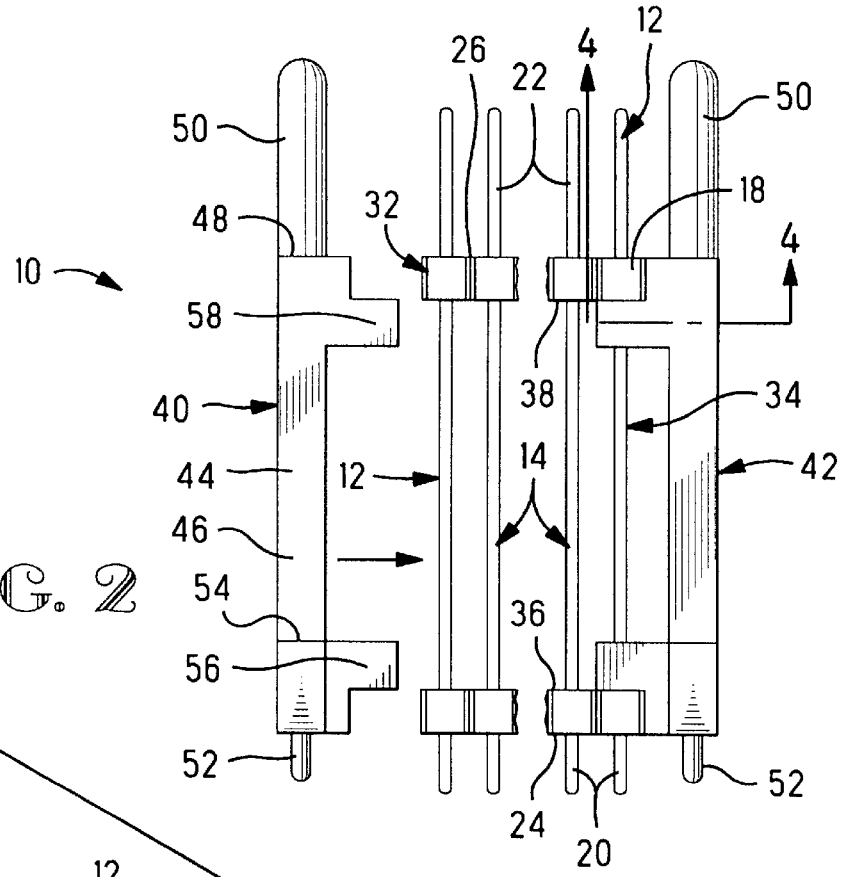
FIG. 2 is an enlarged elevation view of the header of FIG. 1 with an adapter exploded from one end thereof.
Figure 3:
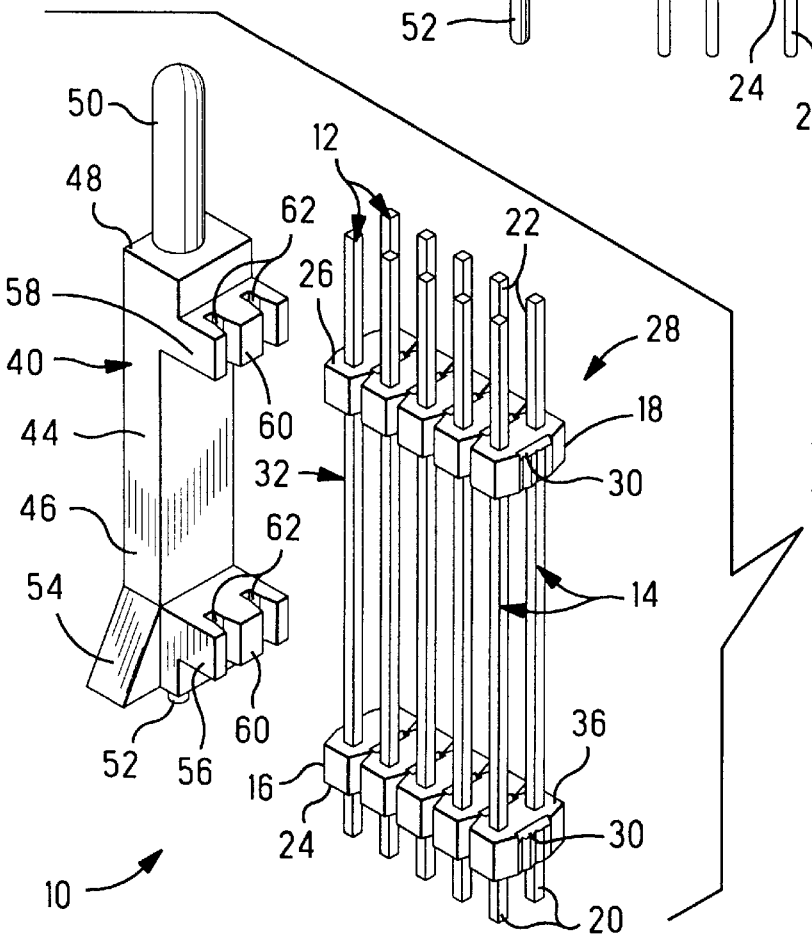
FIG. 3 is an enlarged isometric view of an end of the header with an adapter of the present invention exploded therefrom.

As seen best in FIG. 4, posts 12 are received into respective grooves 62 until seated snugly within inner groove end portions 68. Preferably posts 12 are held in a force-fit within inner groove end portions 68; and even more preferably, retention embossments 70 are provided along groove side walls 72 that snap about posts 12 to seat the posts in inner groove end portions 68.

The invention provides adapters that are easily affixable to conventional unshrouded headers to establish a blindmate alignment capability with a receptacle connector of a second circuit board, or optionally directly to the second circuit board, without necessitating any modification of the headers.

Modifications and variations may be devised to the adapter of the present invention. For example, such an adapter could be used with a single-row or a three-row header. A slightly different adapter could be used with headers having only a single plastic body, with the fastening projections securing to the end posts adjacent both surfaces of the plastic body. Alternatively, the adapter could be provided with latch arms that would latch directly to the plastic body or bodies instead of the posts. It is clear that such an adapter could utilize features other than an alignment post, such as a board lock or could even contain an additional contact.

What is claimed is:

1. An unshrouded header assembly comprising:

a header subassembly having an array of elongate posts secured to a pair of transverse spaced-apart plastic bodies, said posts having opposed end portions extending beyond respective said plastic bodies and defining opposing first and second connection faces, with end posts located at opposed header ends; and an adapter at and along each said header end, each said adapter including a body section having first and second ends with an alignment post extending from said second end thereof, said body section including fastening projections proximate said first and second ends, said fastening projections extending toward said header subassembly and being self-securable to said end posts at a respective said header end upon assembly in a direction transverse to said end posts and immediately adjacent said plastic bodies, whereby said adapters provide for alignment with a mating connector along said second connection face.

2. The header assembly as set forth in claim 1 wherein said fastening projections extend along inner surfaces of said plastic bodies.

3. The header assembly as set forth in claim 1 wherein each said fastening projection includes a post-receiving groove for each said end post and extending toward said body section from a post-proximate end.

4. The header assembly as set forth in claim 3 wherein said post-receiving grooves include widened entrances having angled surfaces facilitating receipt of respective said end posts thereinto during assembly.

5. The header assembly as set forth in claim 3 wherein said post-receiving grooves include inner end portions that form a force-fit with respective said end posts upon assembly of a said adapter with said header subassembly.

6. The header assembly as set forth in claim 5 wherein said post-receiving grooves include retention embossments that snap about a respective said end post upon seating thereof within said inner end portion of a respective said groove.

7. The header assembly as set forth in claim 3 wherein each said fastening projection includes two said grooves, where said header subassembly has two rows of said posts.

8. The header assembly as set forth in claim 1 wherein said first ends of said adapters include locating posts extending therefrom for receipt into respective mounting holes of a circuit board.

9. The header assembly as set forth in claim 1 wherein said first ends of said adapters include buttresses extending laterally from opposed sides thereof to stabilize the header assembly on a circuit board along said first connection face.

* * * * *